US008529030B2

(12) United States Patent
McCracken et al.

(10) Patent No.: US 8,529,030 B2
(45) Date of Patent: Sep. 10, 2013

(54) CHECK VALVE UNIT FOR SOLID INK RESERVOIR SYSTEM

(75) Inventors: Ivan Andrew McCracken, Portland, OR (US); Chad Johan Slenes, Sherwood, OR (US); Tony Rogers, Milwaukie, OR (US); Shawn Michael Close, Portland, OR (US); William Bruce Weaver, Canby, OR (US); Chad David Freitag, Portland, OR (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 13/364,563

(22) Filed: Feb. 2, 2012

(65) Prior Publication Data

US 2012/0133714 A1 May 31, 2012

Related U.S. Application Data

(62) Division of application No. 12/177,649, filed on Jul. 22, 2008, now Pat. No. 8,162,462.

(51) Int. Cl.
*B41J 2/175* (2006.01)

(52) U.S. Cl.
USPC ..... 347/85; 347/88; 347/99; 137/533

(58) Field of Classification Search
USPC ..... 347/85, 88, 99; 137/533, 533.11, 137/533.17
See application file for complete search history.

(56) References Cited

U.S. PATENT DOCUMENTS

| | | | | |
|---|---|---|---|---|
| 3,315,693 | A | 4/1967 | Braun | |
| 3,620,653 | A | 11/1971 | Gaylord et al. | |
| 4,460,905 | A | 7/1984 | Thomas | |
| 4,646,783 | A | 3/1987 | Bazan et al. | |
| 4,867,140 | A | 9/1989 | Hovis et al. | |
| 5,287,697 | A | 2/1994 | Johnson et al. | |
| 5,343,697 | A | 9/1994 | Johnson et al. | |
| 5,860,793 | A | 1/1999 | Muscarella et al. | |
| 6,668,856 | B2 | 12/2003 | Warlick | |
| 6,799,844 | B2 | 10/2004 | Leighton et al. | |
| 6,866,375 | B2 | 3/2005 | Leighton et al. | |
| 7,188,941 | B2 | 3/2007 | Platt et al. | |
| 7,416,292 | B2 | 8/2008 | Leighton | |
| 7,670,126 | B2 | 3/2010 | McCready et al. | |
| 7,878,637 | B2 | 2/2011 | Leighton | |
| 7,883,198 | B2 * | 2/2011 | McCracken et al. | 347/99 |
| 2004/0114008 | A1 | 6/2004 | Leighton et al. | |

* cited by examiner

*Primary Examiner* — Matthew Luu
*Assistant Examiner* — Rut Patel
(74) *Attorney, Agent, or Firm* — Maginot, Moore & Beck, LLP

(57) ABSTRACT

A check valve unit is provided for a high-speed phase change ink image producing machine between a reservoir for receiving and holding a volume of melted ink from a source and a receiving unit, which may be a printhead system. The check valve unit includes a plurality of ball elements trapped between upper and lower housings defining a like plurality of inlet and discharge passageways. The passageways are configured to optimize flow of melted ink through the unit during charging of the secondary reservoir. The check valve unit is scalable as to size and number of reservoirs for a particular application. The unit further incorporates features that simplify the manufacturing and assembly process while maintaining optimal performance.

14 Claims, 10 Drawing Sheets

CHECK VALVE UNIT FOR SOLID INK RESERVOIR SYSTEM

CROSS-REFERENCE TO RELATED APPLICATION

This application is a divisional of and claims priority to co-pending application Ser. No. 12/177,649, filed on Jul. 22, 2008, the entire disclosure of which is incorporated herein by reference.

BACKGROUND

The following disclosure relates to image producing machines, and more particularly to solid ink machines that use a phase change ink melting and control apparatus.

In general, phase change ink image producing machines, such as printers, employ phase change inks that are in the solid phase at ambient temperature, but exist in the molten or melted liquid phase (and can be ejected as drops or jets) at the elevated operating temperature of the machine or printer. At such an elevated operating temperature, droplets or jets of the molten or liquid phase change ink are ejected from a printhead device of the printer onto a printing media. Such ejection can be directly onto a final image receiving substrate, or indirectly onto an imaging member before transfer from it to the final image receiving media. In any case, when the ink droplets contact the surface of the printing media, they quickly solidify to create an image in the form of a predetermined pattern of solidified ink drops.

An example of such a phase change ink image producing machine or printer, and the process for producing images therewith onto image receiving sheets is disclosed in U.S. Pat. No. 6,905,201, issued on Jun. 14, 2005, to Leighton et al., the disclosure of which is incorporated herein by reference. As disclosed therein, a high-speed phase change ink image producing machine, such as printer 10 shown in FIG. 1, includes a frame 11 to which are mounted directly or indirectly all its operating subsystems and components. One of the components is an imaging member 12 that is shown in the form of a drum, but can equally be in the form of a supported endless belt. The imaging member 12 has an imaging surface 14 that is movable in the direction 16, and on which phase change ink images are formed.

The high-speed solid ink printer 10 also includes a phase change ink system 20 that has at least one source 22 of a single color phase change ink in solid form. When the printer 10 is a multicolor image producing machine, the ink system 20 includes four sources 22, 24, 26, 28, representing four different colors CYMK (cyan, yellow, magenta, black) of phase change ink solid pieces, as shown in FIG. 1. The phase change ink system 20 also includes a solid phase change ink melting and control assembly or apparatus 100 (FIG. 2A) for melting or phase changing the solid form of the phase change ink into a liquid form, and for then supplying the liquid form to the printhead system 30. The printhead system 30 includes at least one printhead assembly 32, or in the case of a high-speed, or high throughput, multicolor image producing machine, four separate printhead assemblies 32, 32, 36 and 38, as shown in FIG. 1.

The solid ink image producing printer 10 further includes a substrate supply and handling system, which may, for example, include multiple substrate supply sources 42, 44, 46, 48. The substrate supply and handling system further includes a substrate treatment system 50 that has a substrate pre-heater 52, substrate and image heater 52, and a fusing device 60. The phase change ink image producing printer 10 as shown may also include an original document feeder 70 that has a document holding tray 72, document sheet feeding and retrieval devices 72, and a document exposure and scanning system 76.

Operation and control of the various subsystems, components and functions of the machine or printer 10 are performed with the aid of a controller or electronic subsystem (ESS) 80. The ESS or controller 80 for example is a self-contained, dedicated mini-computer having a central processor unit (CPU) 82, electronic storage 82, and a display or user interface (UI) 86. The ESS or controller 80 for example includes sensor input and control means 88 as well as a pixel placement and control means 89. In addition the CPU 82 reads, captures, prepares and manages the image data flow between image input sources such as the scanning system 76, or an online or a work station connection 90, and the printhead assemblies 32, 32, 36, 38. As such, the ESS or controller 80 is the main multi-tasking processor for operating and controlling all of the other machine subsystems and functions, including the machine's printing operations.

In operation, image data for an image to be produced is sent to the controller 80 from either the scanning system 76 or via the online or work station connection 90 for processing and output to the printhead assemblies 32, 32, 36, 38. The controller determines and/or accepts related subsystem and component controls, for example from operator inputs via the user interface 86, and accordingly executes such controls. As a result, appropriate color solid forms of phase change ink are melted and delivered to the printhead assemblies. Additionally, pixel placement control is exercised relative to the imaging surface 12 thus forming desired images per such image data, and receiving substrates are supplied by anyone of the sources 22, 22, 26, 28 and handled by means 50 in timed registration with image formation on the surface 12. Finally, the image is transferred within the transfer nip 92, from the surface 12 onto the receiving substrate for subsequent fusing at fusing device 60.

In certain machines, the phase change ink system 20 includes a solid phase change ink melting and control apparatus 100 (FIG. 2A), including a pre-melter assembly 200 and a melter assembly 300. The pre-melter assembly 200 is suitable for controllably supplying solid pieces of phase change ink from the sources 22, 22, 26, 28 (FIG. 1) to the melter assembly 300 located below the pre-melter assembly 200, and more particularly to the separate melters 300A-D. A melted molten liquid ink storage and control assembly 400 is located below the melter assembly 300.

In high throughput solid ink systems, the storage and control assembly 400 may incorporate a dual reservoir system corresponding to each of the individual melters 300A-D for the various colors implemented in the solid in system. In this system, molten liquid ink is fed from a corresponding melter 300A-D into an associated primary reservoir 404A-D, which stores a first volume of melted ink for subsequent use. This reservoir is connected through a check valve or backflow prevention valve assembly 408 to a corresponding secondary reservoir 406 which stores a second volume of melted liquid ink. The liquid ink is ejected from the storage and control assembly 400 at an outlet array 410 and typically fed through a heated routing system to reach a respective printhead or printheads of the printhead assembly 30. In systems of this type, pressure is applied at particular ones of the secondary reservoirs 406 to discharge ink through a corresponding outlet 410, such as through a piston or pressurized air arrangement. The check valve assembly 408 prevents backflow of liquid ink from the now pressurized secondary reservoir back into the primary reservoir 404.

In a typical prior art system, the check valve assembly 408 includes an individual check valve for each primary reservoir 404A-D. Although each check valve is integrated into a common housing, the check valve itself is usually an off-the-shelf single valve that is supported within the housing. The check valves of the prior art are often ball valves, although needle and flapper or disc valves have also been used. The nature of the check valves used in prior art systems places significant limitations on the size of the valve assembly 408. In other words, the nature of these prior check valve configurations requires a certain amount of space or a particularly large envelope so that a reduction in space requirements are not a viable option. Limitations on the "smallness" of the space requirements for the check valve assembly 408 cascades into limitations on the size and positioning of the first and second reservoirs 404, 406 served by the valve assembly.

Another difficulty with the check valve assemblies used in prior art machines is that they are typically formed of stainless steel. These stainless steel components require a warm-up time that is not conducive to a high speed, quick reacting printing machine. Since the printing machine utilizes molten ink, all of the components must be "at temperature" when the machine is operated to maintain ink in its molten state. Bringing the check valve assembly to temperature is particularly important since any partially solidified ink within the valve assembly can hold the check valve in an open or closed position, thereby destroying the functionality of the particular check valve.

There is a need for a check valve assembly that is readily scalable depending upon the nature of the printing machine. Such a check valve assembly should also be easy and inexpensive to manufacture, without sacrificing, and preferably improving, flow of molten ink through the valve.

SUMMARY

According to aspects illustrated herein, there is described a check valve unit for use in a high-speed phase change ink image producing machine having a printhead system and a system for feeding and controlling melted liquid ink provided to the printhead system, the printhead system having a plurality of printheads, the feeding and controlling system having a plurality of first storage reservoirs for receiving and holding a first volume of melted ink of a plurality of different colors delivered from a source and a like plurality of second storage reservoirs for holding a second volume of melted ink of the plurality of different colors to be delivered to ones of the plurality of printheads upon pressurization of corresponding ones of second storage reservoirs. The valve unit is coupled to the machine to be operable in an open position to control the flow of melted ink from each of the second storage reservoirs to the printhead system and in a closed position to prevent backflow of melted ink from the printhead system to the secondary reservoirs.

In certain embodiments, the valve unit comprises a lower valve housing defining a plurality of inlet passageways therethrough in communication with a corresponding one of a plurality of storage reservoirs, each inlet passageway defining a valve seat and a valve axis aligned with the valve seat. The valve unit further comprises a corresponding plurality of ball elements, each sized to seat on a corresponding valve seat in the closed position to prevent backflow through the corresponding inlet passageway. An upper valve housing mates with the lower valve housing to capture each of the plurality of ball elements. The upper valve housing defines a like plurality of discharge passageways in communication with at least one receiving unit, which may be a printhead of the printhead system, and aligned with a corresponding inlet passageway. In certain embodiments, each discharge passageway includes a first portion sized to receive a corresponding ball element when the ball element is unseated from the valve seat in the open position, the first portion aligned with the valve axis, and a second portion offset from the valve axis and communicating with the first portion at an intersection, the intersection sized to prevent passage of the ball element from the first portion into the second portion.

In another embodiment, the lower valve housing of the valve unit defining a plurality of inlet passageways, each inlet passageway defining a valve seat and a moat surrounding the valve seat. In a further embodiment, the inlet passageway includes an elongated bore having a first portion with a first diameter that defines a valve seat, and a second portion having a second diameter smaller than the first diameter. In manufacturing the lower housing with this feature, the second portion may be formed by drilling through the housing from a first surface of the housing. The first portion may then be formed by a higher precision drilling operation from an opposite surface of the housing.

In one embodiment, a check valve unit comprises a lower valve housing defining a plurality of inlet passageways therethrough in communication with a corresponding one of a plurality of storage reservoirs, each inlet passageway defining a valve seat; a corresponding plurality of ball elements, each sized to seat on a corresponding valve seat in the closed position to prevent backflow through the corresponding inlet passageway; and an upper valve housing mated to the lower valve housing to capture each of the plurality of ball elements between the upper and lower housings, the upper valve housing defining a like plurality of discharge passageways in communication with at least one receiving unit, which may be a printhead of the printhead system, and aligned with a corresponding inlet passageway. In this embodiment, the lower valve housing and the upper valve housing define mating surfaces, and each of the discharge passageways defines an end wall facing the valve seat, the end wall being offset from the mating surfaces by a depth greater than the diameter of one of the ball elements. In another embodiment, the end wall is angled to diverge from the mating surface toward a discharge opening in the upper housing.

In a further embodiment, the valve unit is provided with at least two alignment pins supported by one of the lower and upper valve housing, each of the alignment pins projecting from the mating surface and a surface opposite the mating surface. Alignment bores are defined in the other of the lower and upper valve housing, each alignment bore aligned to receive a corresponding one of the alignment pins.

A method for manufacturing a valve seat arrangement in a valve housing is provided that comprises providing at least one bore through the valve housing, positioning a ball element on each bore, the ball element formed of a harder material than the material of the valve housing at the bore, and pressing the ball element into the valve housing to deform the valve housing in the vicinity of the bore. Where two or more ball elements are provided, the method may include simultaneously pressing each ball element into a corresponding bore.

The valve unit disclosed herein is well-suited for use in a high throughput, high speed phase change ink image producing machine, such as a high speed solid ink printer.

DETAILED DESCRIPTION OF THE EMBODIMENTS

Figure 1:
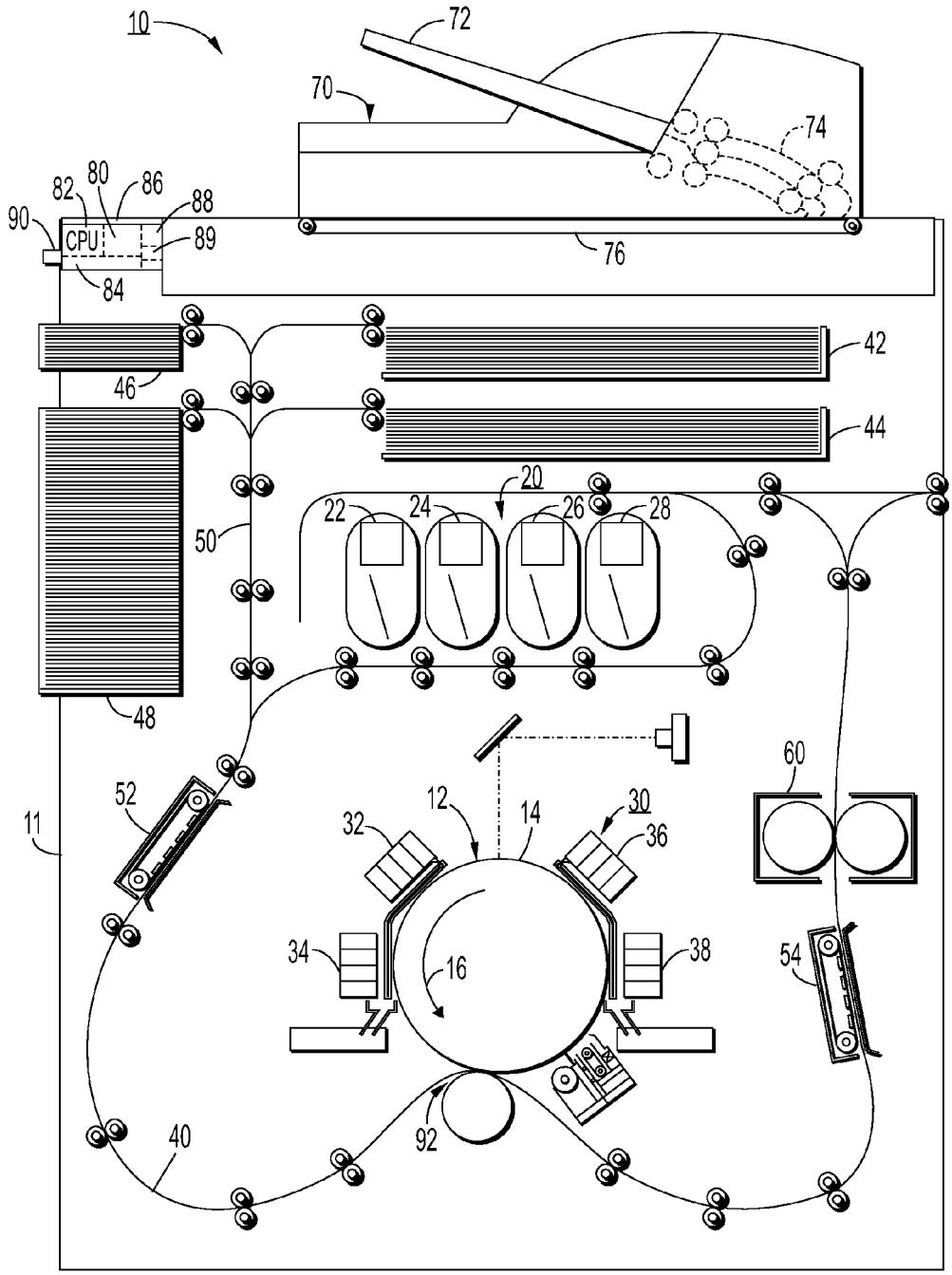
FIG. 1 is a vertical schematic of a high-speed phase change ink image producing machine or printer.

According to one embodiment, a check valve unit 450 is provided that can be integrated into a printing machine, such as the machine 10 shown in FIG. 1. The unit 450 is especially adapted for a phase change ink melting and control apparatus as depicted schematically in FIG. 2B. In this unit, the melter assembly 300' may incorporate an array of angled heated plates for each color solid ink stick. The melted ink drips from the plate into a primary, or low pressure, reservoir 404' and the molten ink is fed to a secondary, or high pressure, reservoir 406' through a passive check valve 408'. This valve 408' may operate as described above to prevent backflow of ink from the secondary reservoir to the primary reservoir when the secondary reservoir 406' is pressurized. The check valve unit 450 is interposed between the outlet of each secondary reservoir 406' and an outlet array 410'. The outlet array supplies the molten ink to each printhead 30' and may comprise an array of tubes feeding each printhead with multiple colors of molten ink.

Figure 2A:
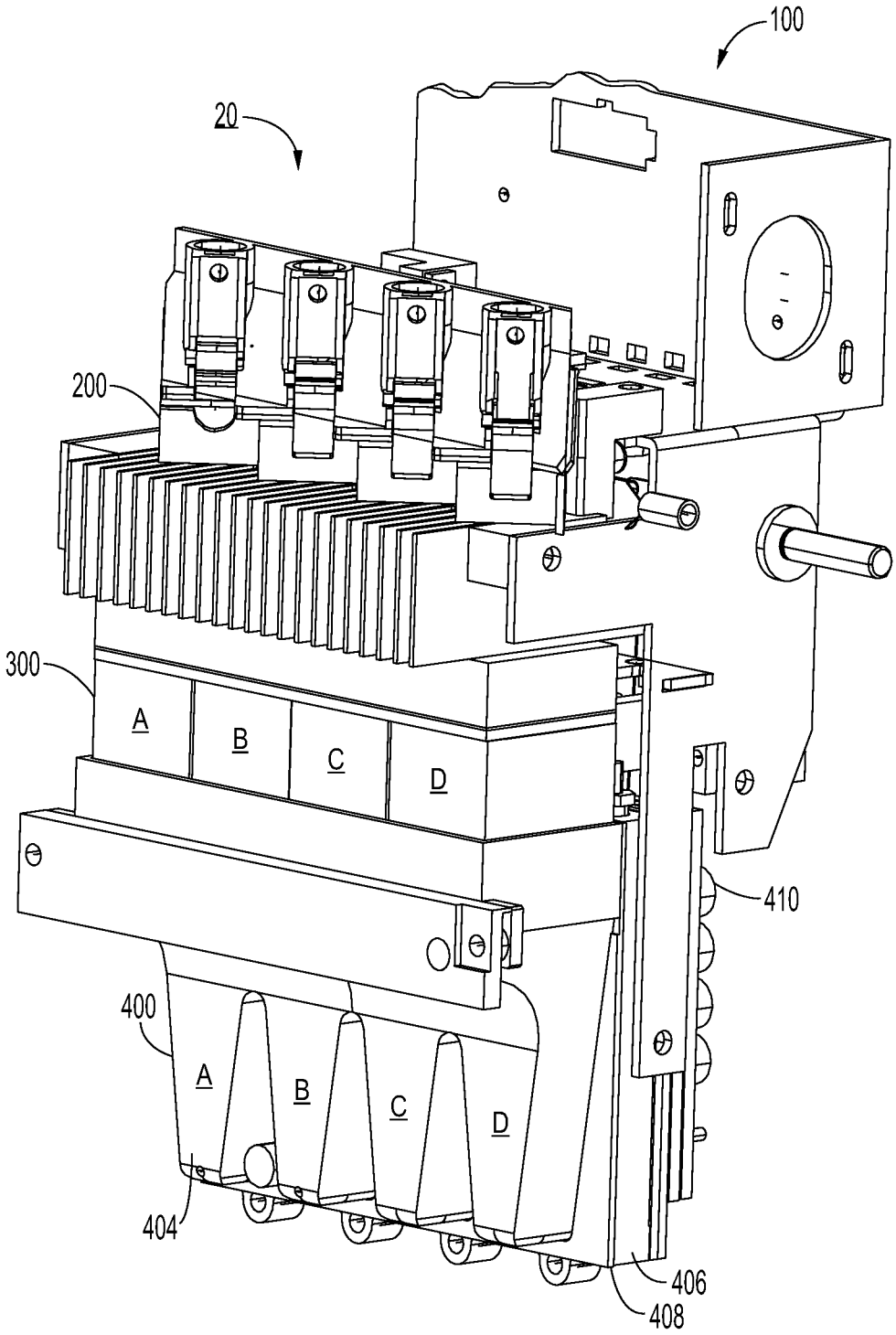
FIG. 2A (PRIOR ART)
FIG. 2A is a perspective view of a phase change ink melting and control apparatus used in the machine shown in FIG. 1.
Figure 2B:
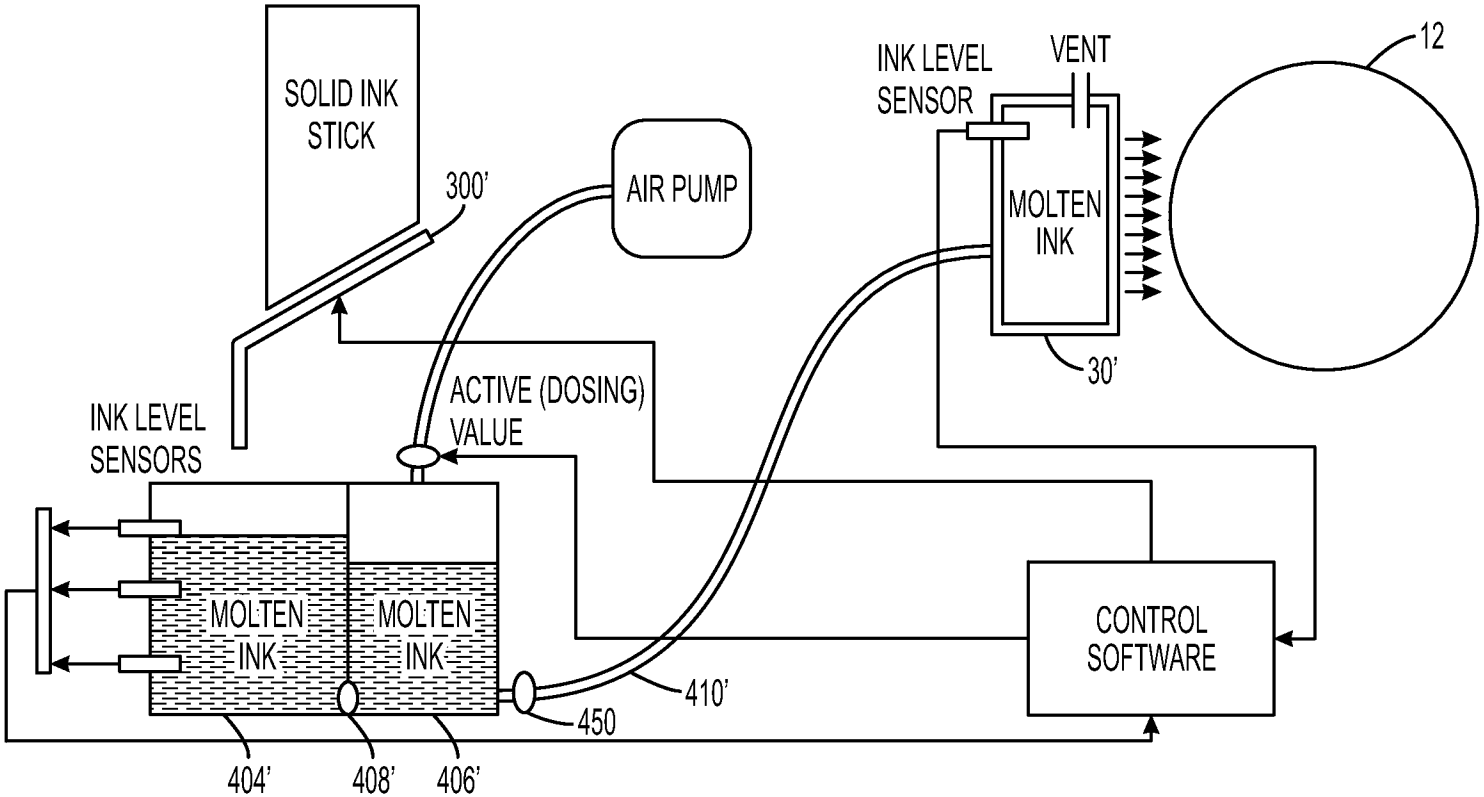
FIG. 2B is a schematic view of an alternative phase change ink melting and control apparatus.

In the modified apparatus shown schematically in FIG. 2B the printheads 30' are located physically above the secondary reservoirs. Thus, molten ink fed to each printhead will tend to drain downward back into the secondary reservoirs after a printing operation has been completed. The check valve unit 450 operates as a non-return valve in that it prevents the molten ink from flowing back into the reservoir. When it is desired to charge a printhead with ink, pressure is applied to the ink in the secondary reservoir 406', such as from an air pump through a dosing valve as depicted in FIG. 2B. In this condition, the control valve unit 450 described herein opens to permit the flow of molten ink from the secondary reservoir to the printhead.

Figure 3:
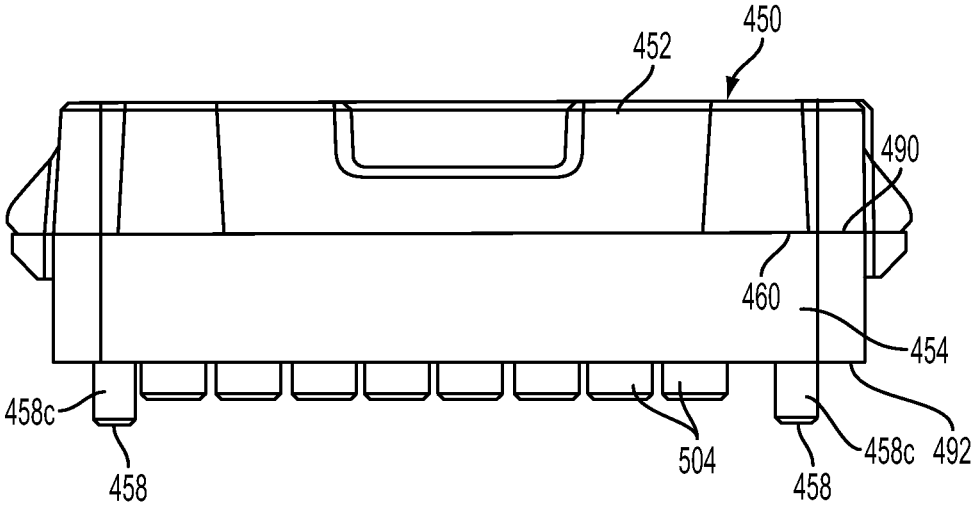
FIG. 3 is a side view of a check valve unit according to one embodiment disclosed herein.
Figure 4:
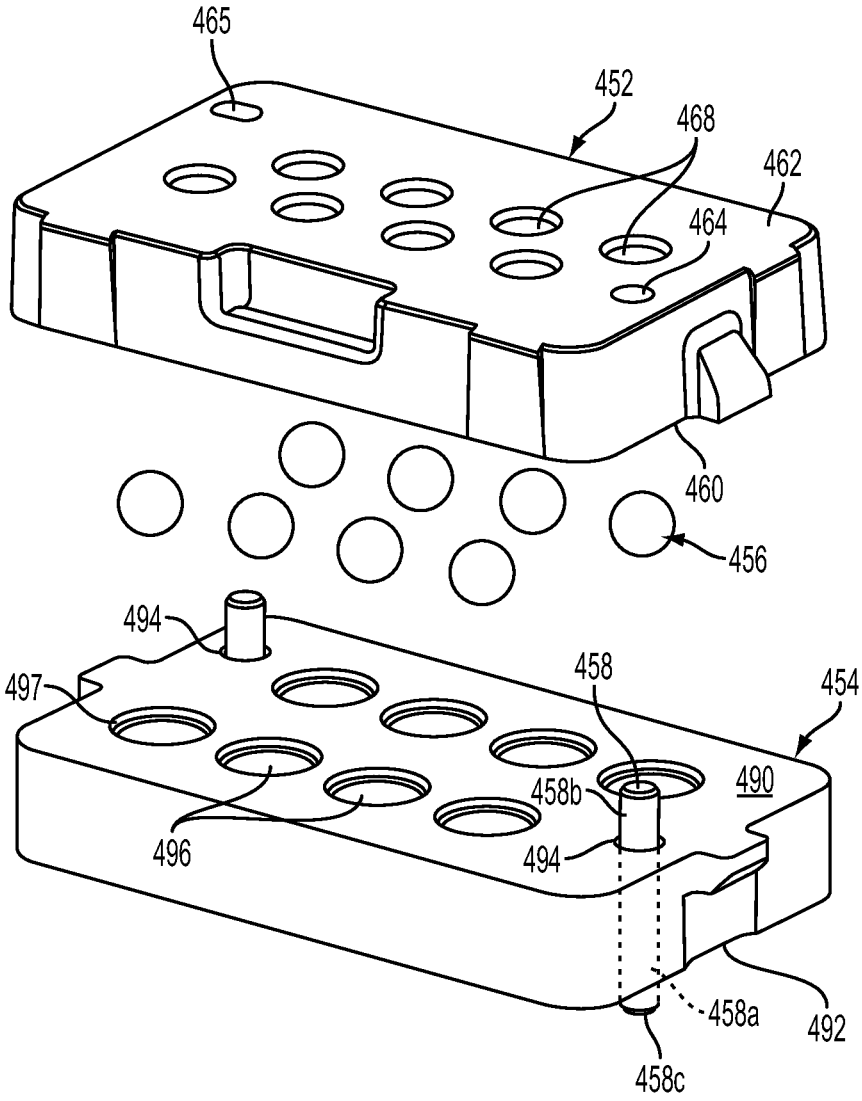
FIG. 4 is an exploded perspective view of the check valve unit depicted in FIG. 3.

The unit 450 includes two housing halves, as shown best in FIGS. 3-4, an upper housing 452 and a lower housing 454 that are mated and sealed together to trap ball elements 456 within flow passageways defined in the housings. In a preferred embodiment, the housings mate at associated mating surfaces 460, 490, which are manufactured to be held at a tolerance sufficient to ensure fluid tight sealing of the two halves together. In one embodiment, the valve housings 452, 454 are die cast of a material having a high thermal conductivity, such as aluminum, and then machined to incorporate the various flow passageway and valve features. The two housings may be sealed together by an adhesive. In some embodiments, the adhesive may be a thermally-cured silicone-based adhesive suitable for bonding aluminum and capable of accommodating potential thermal expansion of the housings.

As shown in FIG. 4, the housings 452, 454 are maintained in alignment by a pair of alignment pins 458 disposed between the housings. In one embodiment, each pin 458 includes a portion 458*a* that is press-fit within alignment bores 494 defined in the lower housing 454 from the mating surface 490 to the opposite lower surface 492 of the housing. The alignment bores are asymmetrically positioned at opposite sides of the housing, as illustrated in FIG. 4, so that the two housings cannot be misassembled. Each pin 458 includes an alignment portion 458*b* that projects above the mating surface 490 of the lower housing 454 when the pins are press-fit into their corresponding bores. The upper housing 452 includes an alignment bore 464 and an alignment slot 465 that are arranged to receive the alignment portion 458*b* of a corresponding pin when the two halves are mated. The slot 465 provides some tolerance between the relative positions of the alignment bores 494 in the lower housing 454 and the corresponding bore and slot 464, 465 in the upper housing 452.

In a further feature, each alignment pin 458 includes an exterior alignment portion 458*c* that is configured to be received within alignment bores of the storage and control assembly 400 or some other component of the machine 10. The alignment pins 458 thus provide a means for ensuring proper alignment and orientation of the control valve unit 450 when it is mounted within the machine.

Figure 5:
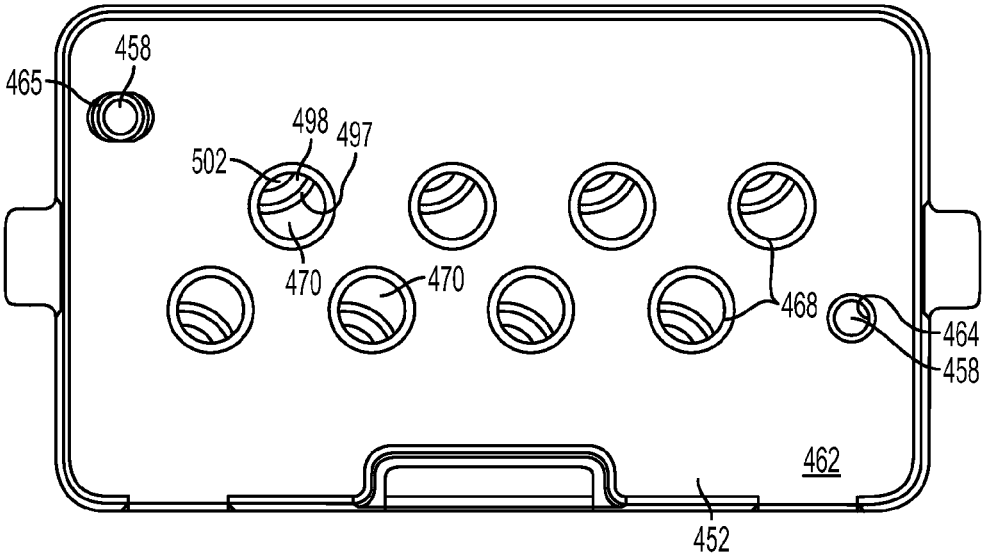
FIG. 5 is a top view of the check valve unit shown in FIG. 3.
Figure 6:
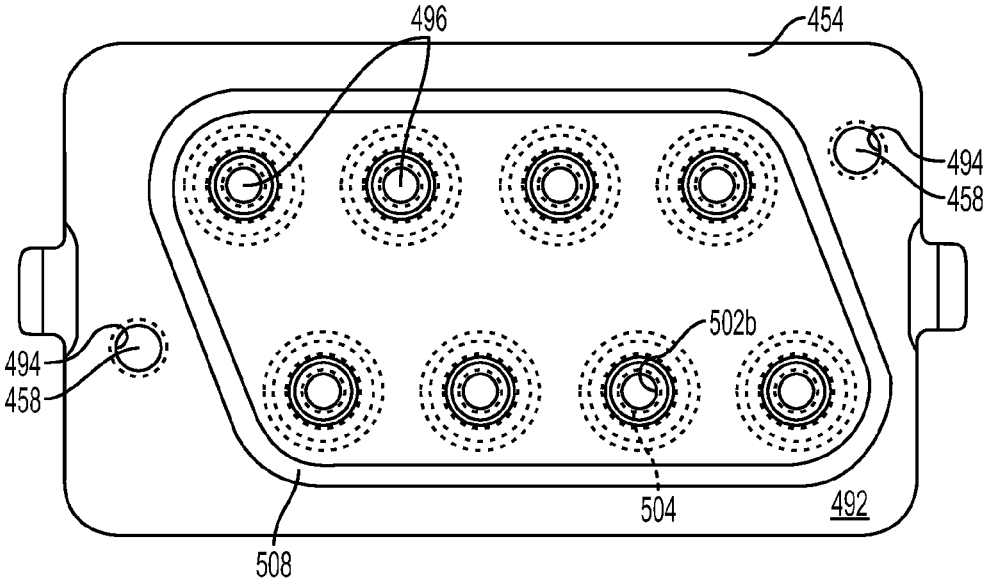
FIG. 6 is a bottom view of the check valve unit shown in FIG. 3.

As illustrated in FIGS. 4-6, the check valve unit 450 defines various openings and passageways for communicating molten ink from the secondary reservoirs 404A-D to the outlet array 410'. Thus, the upper housing 452 defines a plurality of discharge openings 468 that may be fluidly connected to the outlet array in a conventional fashion. The lower housing 454 defines a like plurality of inlet passageways 496 that are fluidly coupled to a corresponding secondary reservoir 406'. In one embodiment, the lower housing defines a stem 504 through which each inlet passageway 496 passes, with each stem configured to be fluidly coupled to a mating component of the secondary reservoirs 406'.

The valve unit 450 includes eight ball elements 456 corresponding to eight inlet passageways 496 and eight discharge openings 468. This particular unit may provide four ink colors to two different printheads, such as printheads 32, 34 in FIG. 1. An additional valve unit may be incorporated into the machine 10 to provide the four ink colors to two additional printheads, such as printheads 36, 38. If the machine has more printheads, additional valve units may be provided. Moreover, it is understood that the eight valve elements can correspond to eight ink colors being fed to a single printhead. However, one benefit shared in any adaptation or use of the valve unit 450 is that the size the unit is kept to a minimum so that multiple units can be readily introduced into a larger multiple color, multiple printhead system. This feature of the valve unit 450 is accomplished in part by the manner in which the ink flow passageways are defined in the upper and lower housings of the unit.

Figure 7:
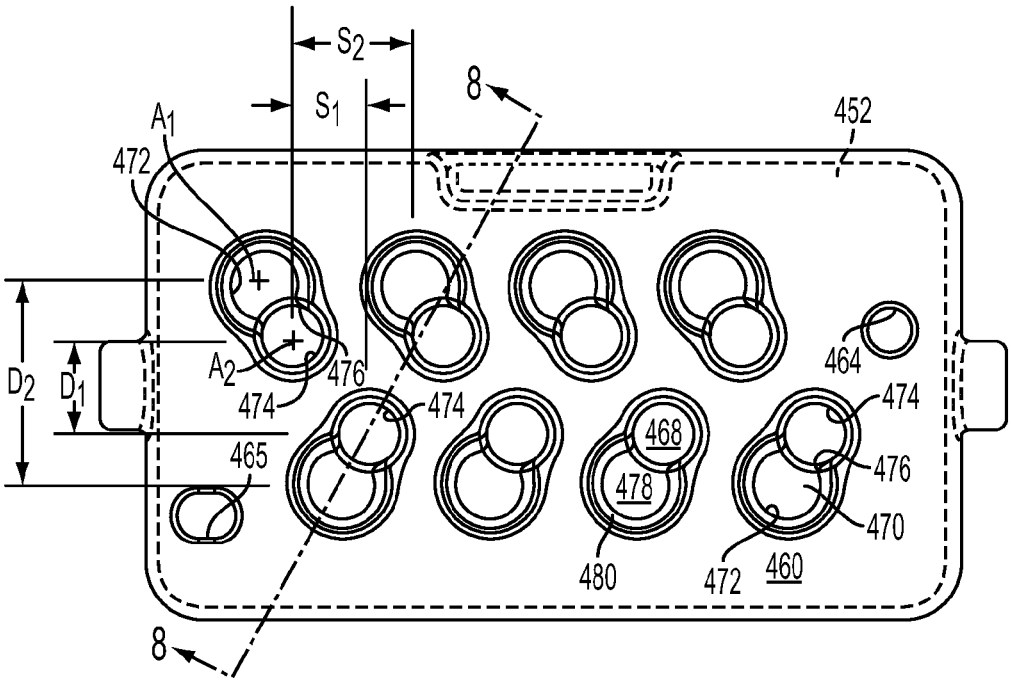
FIG. 7 is a bottom view of the upper housing of the check valve unit shown in FIG. 3.
Figure 8:
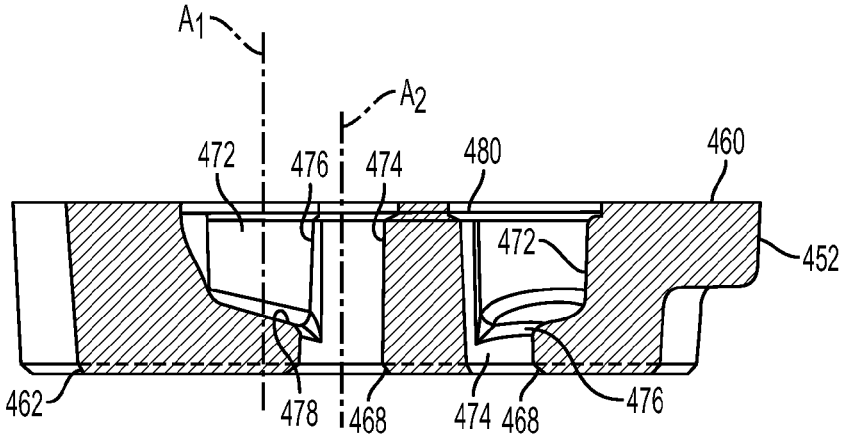
FIG. 8 is a cross-sectional view of the upper housing shown in FIG. 7, taken along line 8-8 as viewed in the direction of the arrows.

In particular, as shown in the top view of FIG. 5, the discharge openings 468 are compactly arranged in an alternating fashion. As shown in the bottom view of FIG. 6, the inlet passageways 496 are also arranged in alternating fashion, although they are offset outboard relative to the discharge openings. This offset is achieved by the unique configuration of the discharge passageways 470 in the upper housing 452, as best seen in FIGS. 7-8. In particular, the discharge passageways 470 include a first portion 472 that is aligned along an axis $A_1$ and a second portion 472 that is offset from the first portion along an axis $A_2$. The two portions are in communication at an intersection 476 so that molten ink can pass freely from the first portion 472 into the second portion 474. As seen in FIG. 8, the second portion 474 intersects the upper surface 462 at the discharge opening 468 that is configured to communicate with the outlet array 410', as discussed above.

Figure 9:
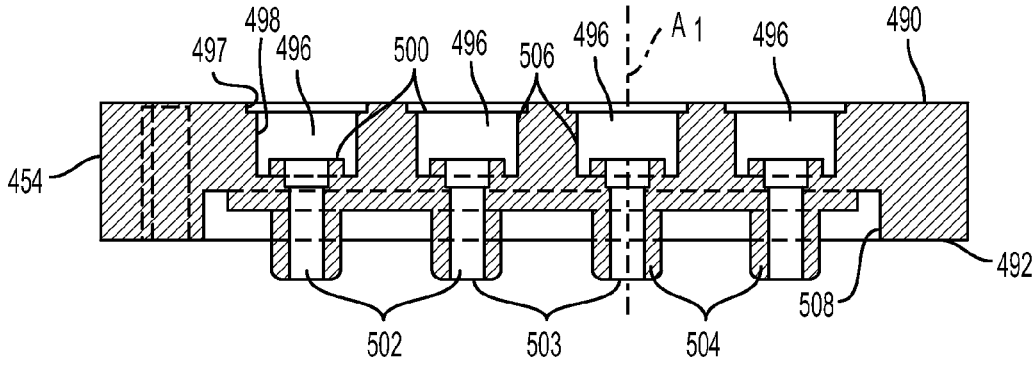
FIG. 9 is a side cross-sectional view of the bottom housing of the check valve unit shown in FIG. 3.

Looking next at FIG. 9, the construction of the lower housing 454 is illustrated. As previously explained, the lower housing includes a mating surface 490 that mates with the mating surface 460 of the upper housing 452. The inlet passageways 496 open at this mating surface and are in communication with the first portion 472 of the discharge passageways 470 of the upper housing when the two housings are combined. Thus, the molten ink flows through the inlet passageway 496 into the first portion 472, through the intersection 476 and into the second portion 494, to be discharged through the discharge openings 468. This flow of molten ink is controlled by the check valve features of the valve unit 450, and in particular by the ball elements 456 disposed within the combined inlet and discharge passageways 496, 470, respectively. (See, FIG. 10).

The inlet passageway 496 includes a mating recess 497 at the mating surface 490 of the lower housing that is sized to coincide with the mating recess 480 at the mating surface 460 of the upper housing. This mating recess 497 opens into a ball chamber 498 within which the ball element 456 is disposed, at least in its closed position. In order to accommodate the check valve ball elements, the lower housing 454 defines a ball seat 500 in each ball chamber 498. This ball seat projects above the base of the ball chamber to define a moat 506 around the seat 500.

A central bore 502 is defined through the ball seat 500 ultimately defining an inlet opening 503 at the end of an inlet stem 504 that projects from the lower surface 492 of the lower housing. In one embodiment, the lower surface 492 further defines a mounting recess 508 around the collection of inlet stems 504 (see FIG. 6). This mounting recess and the inlet stems can provide an interface to mount the check valve unit 450 to structure defining the secondary reservoirs 406'. It is understood that the configuration of these features can be modified as necessary for mounting the check valve unit 450 to a particular molten ink storage and control assembly.

Figure 10:
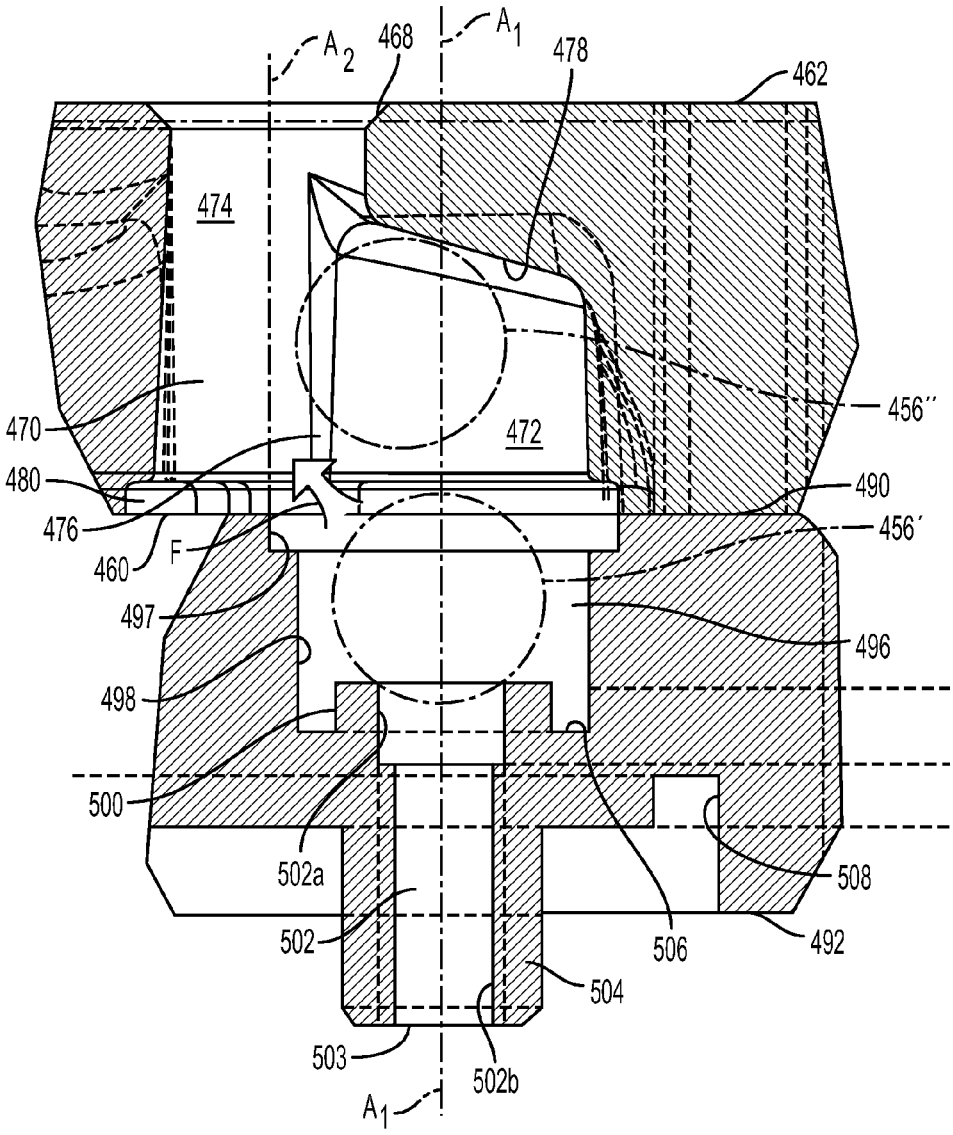
FIG. 10 is an enlarged side cross-sectional view of a portion of the check valve unit illustrated in FIG. 3, shown with a ball element in its closed and open positions.

As shown in FIG. 10, when the upper and lower housings are mated, the central bore 502 of the inlet passageways 496 are aligned along the axis $A_1$ and more particularly aligned with the first portion 472 of the discharge passageway 470. The ball element is initially supported on the ball seat 500, as represented by the ball element 456', blocking or closing the central bore 502 and preventing liquid flow through the bore into the ball chamber 498 and into the discharge passageway 470. In this position, the ball element acts as a check valve to prevent backflow of liquid ink back through the central bore 502. As described above, liquid ink contained within the secondary reservoir 406 is discharged to a corresponding printhead by pressurizing the reservoir. This pressure forces molten ink out of the reservoir, with the majority of the ink traveling to the printhead. However, some portion of the ink will be forced back under pressure into the discharge passageway 470 of the check valve unit 450. This pressurized backflow, along with gravity for a vertically oriented valve unit, will push the ball element 456 against the ball seat 500 and the ball element will prevent this backflow from entering the inlet passageway and the primary reservoir.

Figure 11:
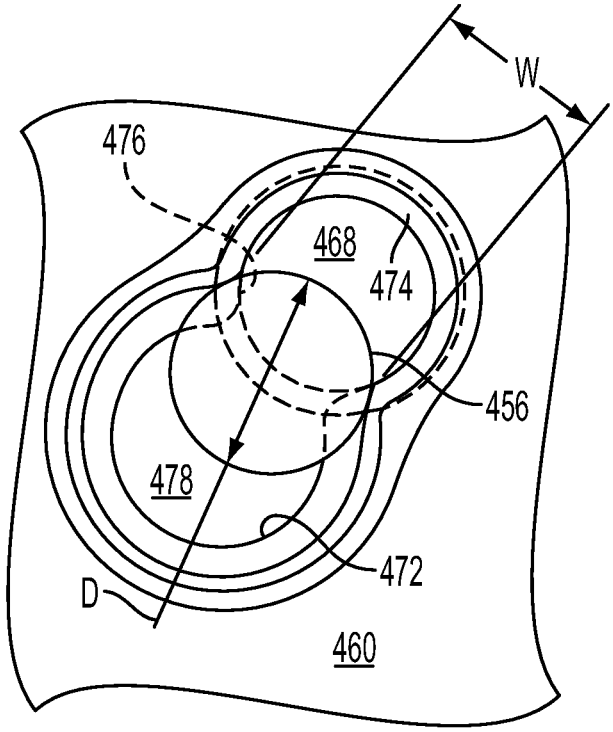
FIG. 11 is an enlarged bottom view of a discharge passageway of the upper housing shown with a ball element in its open position.

In the normal print cycle, once the secondary reservoir 406' has been purged, it is refilled with liquid ink from the associated primary reservoir 404'. A corresponding secondary reservoir is then pressurized to force liquid ink through the inlet opening 503 and into the inlet passageway 496, and more particularly into the central bore 502. This pressurized flow of ink dislodges the ball element from the ball seat 500 to the position 456" so that liquid ink can flow from the inlet passageway 496 into the discharge passageway 470. When the ball element is unseated, it is forced under pressure upward into the first portion 472 of the discharge passageway 470. As the pressurized flow carries the ball element with it, the ball element contacts the intersection 476 between the first and second portions to prevent passage of the ball element into the second portion 474 which would otherwise block fluid flow exiting the discharge opening 468. Thus, as shown in the detail view of FIG. 11, the intersection 476 has a width dimension W that is less than the diameter D of the ball element.

In a typical check ball configuration, the fluid flow is entirely axial, which requires the liquid to flow around the check ball when it is unseated. In one feature of the check valve unit 450 disclosed herein, the inlet passageway 496 and discharge passageway 470 are configured to provide a flow path that "jogs" around the dislodged ball element in its open position 456". This flow path is provided in part by the ball chamber 498 that has a larger diameter than the ball element. The mating recesses 497 and 480 can be included to provide an even larger flow area at the mating interface between the housings. In a further feature to enhance the fluid flow path, the first portion 472 of the discharge passageway includes an end wall 478 that is offset from the mating surface 460 a distance sufficient for the ball element to move substantially free of the ball chamber 498 in the inlet passageway 496, as depicted in FIG. 10. This feature provides a flow path F that substantially circumvents the ball element so that this flow is not impeded by resistance that would otherwise be caused by the presence of the ball element in the flow path. This clear flow path allows the liquid ink to be quickly dispensed from the secondary reservoir 406. This rapid response time permits faster printing operations which is especially valuable for high speed printing applications.

The end wall 478 of the first portion 472 of the discharge passageway may incorporate a further beneficial feature. As shown in FIG. 10, the end wall 478 is angled relative to the mating surface 460 of the upper housing 452. In particular, the end wall 478 is angled to diverge from the mating surface toward the second portion 474 of the discharge passageway. This angled configuration provides a path for bubbles that may form during the pressurized charging and discharging of the secondary reservoirs. Any bubbles within the passageways will float upward within the first portion 472 and will continue to float upward along the angled end wall 478 into the second portion 474 where the bubbles can float freely through the discharge opening 468. The bubbles can be thus eliminated from the valve unit thus preventing interactions with the valve performance that may result from meniscus forces.

It can be appreciated that the offset between the inlet passageway 496 defined along axis $A_1$ and the outlet opening 468 defined along the axis $A_2$ provides smooth, rapid response flow of molten ink from the secondary reservoirs to the outlet array. Referring back to FIG. 7, it can be seen that the discharge passageways 470 are compactly arranged while maintaining sufficient distance between openings in the mating surface 460 to prevent cross leakage between passageways. Thus, the distance $D_1$ between the two horizontal lines of second portions 474 can be kept to a minimum by offsetting the portions by the distance $S_1$. This offset $S_1$ thus increases the spacing between portions 474 which reduces the risk of cross-leakage. The distance $D_2$ between the first portions 472 is minimized by orienting the discharge passageways at an angle relative to the horizontal line of second portions 474. The angular orientation is configured to ensure an optimum spacing $S_2$ between the first portion 472 of one discharge opening and the second portion 474 of an adjacent discharge opening. This placement of discharge openings in the upper housing 452 thus provides a very compact arrangement without the risk of cross-leakage between discharge openings. The positioning of the first portions 472 of the discharge passageways also allows for compact positioning of the inlet passageways 496 in the lower housing 454, as seen in FIG. 5.

In one embodiment, the housings 452, 454 of the check valve unit 450 may be initially cast from aluminum. Detailed features of the housings may be then machined in a conventional manner. The check valve unit incorporates certain features that enhance and simplify the manufacturing process for the check valve unit. For instance, the central bore 502 of the lower housing 454 includes a seat portion 502*a* and an inlet portion 502*b*. The seat portion 502*a* is preferably held to tight tolerances because it provides the seat for the ball element 456. It is thus preferred that the seat portion 502*a* define a sharp edge at its interface with the ball element. The seat portion is further preferably provided at a consistent radial wall thickness. However, the remainder of the central bore 502 does not require such precision. Thus, in one feature, the central bore 502 is initially formed by drilling from the lower surface 492 through the entire housing at the diameter of the inlet portion 502*b*. If the ball chamber 498 is not cast into the initial form, the chamber can be machined in a conventional manner from the mating surface 490, including the moat 506. Then, the more critical feature, the seat portion 502*a* may be precision machined from the mating surface, ensuring sufficient wall thickness in the valve seat 500 around the seat portion 502*a* of the central bore and achieving the necessary sharp edge at the opening of the seat portion.

In one embodiment, the housing halves are mated using an adhesive joint. The check valve unit 450 incorporates certain features that facilitate assembling the upper and lower housings and the ball elements. In one feature, the end wall 478 is positioned at a height above the mating surface 460 so that the ball elements 456 can be held away from the mating surface when adhesive is applied. It is thus contemplated that the ball elements 456 are formed of a magnetic material, such as steel. A magnet laying on the upper surface 462 when the adhesive is applied and being cured will pull the ball elements upward against the end wall 478, as shown in the position 456" in FIG. 10. In this position, the ball elements are offset from the mating surfaces 460, 490 so any adhesive that may leak into the mating recesses 480, 497 cannot contact and compromise the ball elements.

The moat 506 in each inlet passageway 496 provides an additional region for capturing excess adhesive that may leak into the passageway when the housings are pressed together. The excess adhesive will drip down the wall of the ball chamber 498 and into the moat 506 surrounding the ball seat 500. The moat 506 is sufficiently deep so that no excess adhesive can flow into the surface of the ball seat 500 or into the seat portion 502*a* of the central bore 502. It can also be appreciated that the moat 506 helps make the valve unit more robust to contaminants that might otherwise rest on the valve seat itself.

Figure 12:
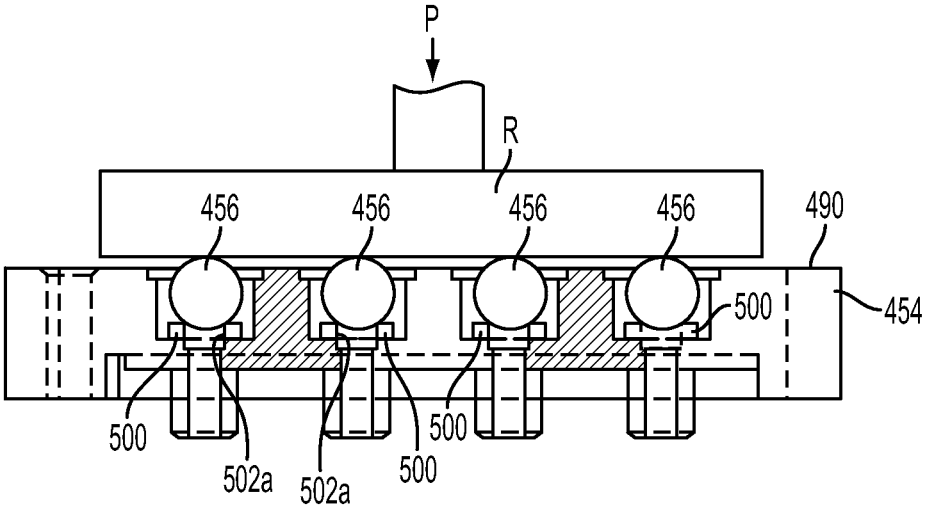
FIG. 12 is a side view of the bottom housing of the check valve unit disclosed herein, shown in one step of the process for manufacturing the housing.

In some instances the sharp edge contact with the spherical surface of the ball element provides sufficient sealing, particularly at lower pressures. However, in higher pressure or rapid, high volume applications, additional sealing capability is desirable. Additional sealing may be provided by increasing the area of contact between the ball element 456 and the ball seat 500. This additional sealing area has been traditionally achieved by machining and polishing a chamfer at the opening to be engaged by the ball element. However, this approach requires precision machining. In order to maximize the sealing capabilities of the ball elements in the ball seats, certain embodiments contemplate a novel coining operation. In accordance with one embodiment, each ball element 456 is placed within the lower housing 454 on a respective valve seat 500 covering the corresponding seat portion 502*a* of the central bore, as shown in FIG. 12. In this position, a portion of the ball elements project above the mating surface 490 of the lower housing. A pressure plate R is placed on top of the ball elements, as shown in the figure. Pressure P is applied to the plate R which presses each ball element 456 into a corresponding ball seat 500. In this embodiment, the housing is formed of a softer material than the ball element so only the ball seat 500 deforms under the applied pressure. The upper edge of the seat portion 502*a* of the central bore 502 is thus coined into a radiused chamfer that corresponds to the radius of the ball element 456. This radiused chamfer thus provides an optimum sealing surface between the ball seat and the ball element.

The check valve unit 450 of the illustrated embodiments provides significant flexibility at a low cost. In particular, since multiple check valves are incorporated into a common housing, increasing the number of check valves does not entail an increase in components, other than additional ball elements. Since all of the inlet and discharge passageway features are formed in the upper and lower housings, adding check valves is achieved by forming additional passageways in the housings. In some applications, all of the passageway features may be formed by precision die casting. Even in applications in which certain features of the inlet and discharge passageways must be machined, these particular features readily lend themselves to single step machining on a single multi-tool machine.

As described above, it is contemplated in certain embodiments that the check valve unit will be mounted within the printing machine 10 to maintain the vertical orientation illustrated in FIG. 10. In this orientation, gravity will act on the ball elements 456 to return them to the closed or backflow prevention position 456' when pressurized flow from the primary reservoirs ceases. This vertical orientation also takes full advantage of the angled back wall 478 feature of the discharge passageway portion 472 for dissipation of bubbles from within the liquid ink flow path F.

However, in some machines the structure of the storage and control apparatus 400 may not permit this vertical orientation. In such applications, a spring element may be incorporated between the ball element 456 and the back wall 478 so that the spring element can provide the restoring force to return the ball element to the ball seat. In some applications, the check valve unit 450 may be oriented with the ends vertically arranged. In this orientation, the check valve unit can be positioned so that the second portions 474 of the discharge passageways are vertically above the associated first portion 472. In this orientation, the angled back wall 478 of the first portion will still assist in dispersing bubbles from the valve passageways.

It will be appreciated that various of the above-described features and functions, as well as other features and functions, or alternatives thereof, may be desirably combined into many other different systems or applications. Various presently unforeseen or unanticipated alternatives, modifications, variations or improvements therein may be subsequently made by those skilled in the art which are also intended to be encompassed by the following claims.

For instance, the arrangement of openings in the upper and lower housings may be modified to accommodate a particular printing machine. In addition, in embodiments in which the housings are not mated using adhesive, the moats 506 may be eliminated. Similarly, where precision machining is implemented to manufacture the lower housing 454, the central bore 502 may be formed at a constant diameter. Likewise, where tight tolerances are not required, the need for precision machining of the seat portion 502*a* may not be necessary.

It should be appreciated that the relative dimensions among the components of the check valve unit 450 may be varied depending upon the particular application for the unit. For instance, the relative diameters of the inlet and discharge passageways may be modified depending upon the flow rates, liquid ink viscosity, etc., for the application. The check valve unit of the illustrated embodiments provides great flexibility to permit use of the disclosed features as needed for a particular application.

It can further be noted that the control valve unit 450 has been described as performing as a check valve between the outlet of each of the secondary pressurized reservoirs and the outlet array feeding the printheads of the machine 10. The valve unit may be disposed between a plurality of ink reservoirs and at least one receiving unit through an appropriate outlet array. Thus, in the embodiments described above the receiving units correspond to the four printheads. A similar control valve unit may be positioned between the primary reservoir 404' and the secondary reservoirs 406' as the receiving units, in lieu of the passive check valves 408'. Additional or fewer ink colors and associated reservoirs may be accommodated in the valve unit 450 by changing the number of passageways defined in the valve body housings 452, 454.

What is claimed is:

1. In a high-speed phase change ink image producing machine having a printhead system and a system for feeding and controlling melted liquid ink provided to the printhead system, the printhead system having a plurality of printheads, the feeding and controlling system having a plurality of storage reservoirs for receiving and holding a volume of melted ink of a plurality of different colors and at least one receiving unit for receiving melted ink from one or more of the storage reservoirs, a valve unit operable in an open position to control the flow of melted ink from each of the storage reservoirs to a receiving unit and in a closed position to prevent backflow of melted ink from the receiving unit to each of the storage reservoirs, said valve unit comprising:

a lower valve housing defining a plurality of inlet passageways therethrough in communication with a corresponding one of the plurality of storage reservoirs, each inlet passageway defining a valve seat and a valve axis aligned with said valve seat;

a corresponding plurality of ball elements, each sized to seat on a corresponding valve seat in the closed position to prevent backflow through the corresponding inlet passageway; and an upper valve housing mated to said lower valve housing to capture each of said plurality of ball elements between said upper and lower housings, said upper valve housing defining a like plurality of discharge passageways having a discharge opening in communication with the at least one receiving unit and aligned with a corresponding inlet passageway, each discharge passageway defining an angled end wall facing said valve seat and oriented at a non-perpendicular angle relative to said valve axis, said angled end wall diverging from said valve seat toward said discharge opening, each discharge passageway having a first portion that is cylindrical along said valve axis and sized to receive a corresponding ball element when said ball element is unseated from said valve seat in the open position, said first portion aligned with said valve axis, and each discharge passageway having a second portion offset from said valve axis and communicating with said first portion at an intersection, the second portion being cylindrical along an axis substantially parallel to said valve axis and offset from said valve axis so that said first and second cylindrical portions overlap to define said intersection and the intersection is sized to prevent passage of said ball element from said first portion into said second portion.

2. The high-speed phase change ink image producing machine according to claim 1, wherein said angled end wall is defined between said first portion and said intersection.

3. The high-speed phase change ink image producing machine of claim 1, wherein said cylindrical first portion has a diameter greater than the diameter of said cylindrical second portion.

4. The high-speed phase change ink image producing machine according to claim 1, in which the feeding and controlling system includes a plurality of first storage reservoirs for receiving and holding a first volume of melted ink of a plurality of different colors delivered from a source and a like plurality of second storage reservoirs for holding a second volume of melted ink and in which the at least one receiving unit includes the plurality of printheads, wherein the valve unit is fluidly coupled between the plurality of second storage reservoirs and the plurality of printheads.

5. The high-speed phase change ink image producing machine of claim 1, wherein each inlet passageway includes an elongated bore having a first portion with a first diameter and defining said valve seat, and a second portion in communication with a corresponding one of the plurality of storage reservoirs and having a second diameter smaller than the first diameter.

6. The high-speed phase change ink image producing machine of claim 1, wherein said lower valve housing defines a like plurality of ball chambers between a corresponding valve seat and a corresponding discharge passageway, each ball chamber having a diameter sufficiently larger than the diameter of a corresponding ball element to permit flow of molten ink around said corresponding ball element in the open position.

7. The high-speed phase change ink image producing machine of claim 6, wherein each of said discharge passageways includes a cylindrical portion defined along said valve axis and in communication at one end with a corresponding ball chamber and terminated at an opposite end in said angled end wall, said cylindrical portion having a diameter sufficiently larger than the diameter of a corresponding ball element to permit flow of molten ink around said corresponding ball element in the open position.

8. In a high-speed phase change ink image producing machine having a printhead system and a system for feeding and controlling melted liquid ink provided to the printhead system, the printhead system having a plurality of printheads, the feeding and controlling system having a plurality of storage reservoirs for receiving and holding a volume of melted ink of a plurality of different colors and at least one receiving unit for receiving melted ink from one or more of the storage reservoirs, a valve unit operable in an open position to control the flow of melted ink from each of the storage reservoirs to a receiving unit and in a closed position to prevent backflow of melted ink from the receiving unit to each of the storage reservoirs, said valve unit comprising:

a lower valve housing defining a plurality of inlet passageways therethrough in communication with a corresponding one of the plurality of storage reservoirs, each inlet passageway defining a valve seat and a valve axis aligned with said valve seat;

a corresponding plurality of ball elements, each sized to seat on a corresponding valve seat in the closed position to prevent backflow through the corresponding inlet passageway; and an upper valve housing mated to said lower valve housing to capture each of said plurality of ball elements between said upper and lower housings, said upper valve housing defining a like plurality of discharge passageways having a discharge opening in communication with the at least one receiving unit and aligned with a corresponding inlet passageway, each discharge passageway defining an angled end wall facing said valve seat and oriented at a non-perpendicular angle relative to said valve axis, said angled end wall diverging from said valve seat toward said discharge opening;

said lower valve housing and said upper valve housing define mating surfaces; and said end wall is offset along said valve axis from said mating surfaces by a depth greater than the diameter of a corresponding one of said ball elements.

9. In a high-speed phase change ink image producing machine having a printhead system and a system for feeding and controlling melted liquid ink provided to the printhead system, the printhead system having a plurality of printheads, the feeding and controlling system having a plurality of storage reservoirs for receiving and holding a volume of melted ink of a plurality of different colors and at least one receiving unit for receiving melted ink from one or more of the storage reservoirs, a valve unit operable in an open position to control the flow of melted ink from each of the storage reservoirs to a receiving unit and in a closed position to prevent backflow of melted ink from the receiving unit to each of the storage reservoirs, said valve unit comprising:

a valve housing assembly defining a plurality of inlet passageways therethrough in communication with a corresponding one of the plurality of storage reservoirs and a like plurality of discharge passageways having a discharge opening in communication with the at least one receiving unit and aligned with a corresponding inlet passageway, each inlet passageway defining a valve seat and a valve axis aligned with said valve seat; and a corresponding plurality of ball elements, each sized to seat on a corresponding valve seat in the closed position to prevent backflow through the corresponding inlet passageway, each discharge passageway has a first portion that is cylindrical along said valve axis and sized to receive a corresponding ball element when said ball element is unseated from said valve seat in the open position, said first portion aligned with said valve axis, and a second portion that is cylindrical along an axis substantially parallel to said valve axis and offset from said valve axis, the first and second cylindrical portions overlap to define said intersection and the second portion communicates with said first portion at the intersection, the intersection being sized to prevent passage of said ball element from said first portion into said second portion, and each discharge passageway has an angled end wall facing said valve seat and oriented at a non-perpendicular angle relative to said valve axis, said angled end wall diverging from said valve seat toward said discharge opening.

10. The high-speed phase change ink image producing machine of claim 9, wherein said angled end wall is defined between said first portion and said intersection.

11. The high-speed phase change ink image producing machine of claim 9, wherein said cylindrical first portion has a diameter greater than the diameter of said cylindrical second portion.

12. The high-speed phase change ink image producing machine of claim 9, wherein said valve housing assembly defines a like plurality of ball chambers between a corresponding valve seat and a corresponding discharge passageway, each ball chamber having a diameter sufficiently larger than the diameter of a corresponding ball element to permit flow of molten ink around said corresponding ball element in the open position, and a depth sufficient to contain said corresponding ball element when seated on said valve seat in the closed position.

13. In a high-speed phase change ink image producing machine having a printhead system and a system for feeding and controlling melted liquid ink provided to the printhead system, the printhead system having a plurality of printheads, the feeding and controlling system having a plurality of storage reservoirs for receiving and holding a volume of melted ink of a plurality of different colors and at least one receiving unit for receiving melted ink from one or more of the storage reservoirs, a valve unit operable in an open position to control the flow of melted ink from each of the storage reservoirs to a receiving unit and in a closed position to prevent backflow of melted ink from the receiving unit to each of the storage reservoirs, said valve unit comprising:

a valve housing assembly defining a plurality of inlet passageways therethrough in communication with a corresponding one of the plurality of storage reservoirs and a like plurality of discharge passageways having a discharge opening in communication with the at least one receiving unit and aligned with a corresponding inlet passageway, each inlet passageway defining a valve seat and a valve axis aligned with said valve seat, the valve housing assembly defining a like plurality of ball chambers between a corresponding valve seat and a corresponding discharge passageway, each ball chamber having a diameter sufficiently larger than the diameter of a corresponding ball element to permit flow of molten ink around said corresponding ball element in the open position, and a depth sufficient to contain said corresponding ball element when seated on said valve seat in the closed position; and a corresponding plurality of ball elements, each sized to seat on a corresponding valve seat in the closed position to prevent backflow through the corresponding inlet passageway, each discharge passageway having an angled end wall facing said valve seat and oriented at a non-perpendicular angle relative to said valve axis, said angled end wall diverging from said valve seat toward said discharge opening and said angled end wall is offset along said valve axis from said ball chamber by a depth greater than the diameter of said corresponding ball element.

14. The high-speed phase change ink image producing machine of claim 13, wherein each of said discharge passageways includes a cylindrical portion defined along said valve axis and in communication at one end with a corresponding ball chamber and terminated at an opposite end in said angled end wall, said cylindrical portion having a diameter sufficiently larger than the diameter of a corresponding ball element to permit flow of molten ink around said corresponding ball element in the open position.

* * * * *